US006262648B1

(12) United States Patent
Lammers

(10) Patent No.: US 6,262,648 B1
(45) Date of Patent: Jul. 17, 2001

(54) ELECTROMAGNETIC ACTUATOR

(75) Inventor: Arend Jan Willem Lammers, Hengelo (NL)

(73) Assignee: Holec Holland N.V., Hengelo (NL)

( * ) Notice: Subject to any disclaimer, the term of this patent is extended or adjusted under 35 U.S.C. 154(b) by 0 days.

(21) Appl. No.: 09/508,968

(22) PCT Filed: Sep. 7, 1998

(86) PCT No.: PCT/NL98/00512

§ 371 Date: Mar. 20, 2000

§ 102(e) Date: Mar. 20, 2000

(87) PCT Pub. No.: WO99/14769

PCT Pub. Date: Mar. 25, 1999

(30) Foreign Application Priority Data

Sep. 18, 1997 (NL) ..... 1007072
Apr. 24, 1998 (NL) ..... 1008983

(51) Int. Cl.[7] ..... H01F 7/00; H01F 7/08

(52) U.S. Cl. ..... 335/229; 335/253; 335/254; 335/236; 335/281; 335/256; 335/266; 335/230; 335/177; 335/179; 335/180; 335/182

(58) Field of Search ..... 335/177, 178, 335/179, 180, 182, 183, 229–234, 236, 253, 254, 256, 266

(56) References Cited

U.S. PATENT DOCUMENTS

| | | | | |
|---|---|---|---|---|
| 3,634,735 | * | 1/1972 | Komatsu | 335/234 |
| 4,470,030 | | 9/1984 | Myers | 335/228 |
| 4,550,302 | * | 10/1985 | Watanabe et al. | 335/228 |
| 4,831,973 | * | 5/1989 | Richeson, Jr. | 123/90.11 |
| 5,034,714 | | 7/1991 | Bratkowski et al. | 335/234 |

FOREIGN PATENT DOCUMENTS

| | | |
|---|---|---|
| 1 264 581 | 3/1968 | (DE) . |
| 196 25 657 | 1/1998 | (DE) . |
| 0 380 693 | 8/1990 | (EP) . |
| WO 91/19313 | 12/1991 | (WO) . |

* cited by examiner

*Primary Examiner*—Ramon M. Barrera
(74) *Attorney, Agent, or Firm*—Young & Thompson

(57) ABSTRACT

Electromagnetic actuator for moving a contact into a switched-on or switched-off state, comprising a contact-actuating rod which is displaceable in the longitudinal direction between a first position, corresponding to the switched-off state, and a second position, corresponding to the switched-on state. A core which is made of magnetizable material and interacts with a switch-on coil is attached to the contact-actuating rod. Also present is a pole piece which is made of magnetizable material and of which that face which is directed towards the core, in the first position of the contact-actuating rod, is arranged at an air-gap distance from that surface of the core which is directed perpendicular to the direction of displacement, and in the second position bears as closely as possible against the said core surface. The actuator furthermore comprises a yoke made of magnetizable material for closing the magnetic flux circuit of the switch-on coil through the pole piece and the core. A permanent magnet device is used to maintain the contact-actuating rod, in its second position, towards the first position. The actuator is provided with a switch-off coil which, for the purpose of moving the contact-actuating rod from the second position to the first position, is excited in order to eliminate the magnetic field of the permanent magnet device at least temporarily, the magnetic flux circuit of the permanent magnet device being separate from that of the switch-on coil.

19 Claims, 7 Drawing Sheets

ELECTROMAGNETIC ACTUATOR

BACKGROUND OF THE INVENTION

The invention relates to an electromagnetic actuator for moving a contact into a switched-on or switched-off state, comprising a contact-actuating rod, which is displaceable in the longitudinal direction between a first position, corresponding to the switched-off state, and a second position, corresponding to the switched-on state, a core, which is made of magnetizable material and is attached to the contact-actuating rod, a switch-on coil, which interacts with the core, a pole piece, which is made of magnetizable material and of which that face which is directed towards the core, in the first position of the contact-actuating rod, is arranged at an air-gap distance from that surface of the core which runs perpendicular to the direction of displacement and, in the second position, bears as closely as possible against the said core surface, a yoke, which is made of magnetizable material, for closing the magnetic flux circuit of the switch-on coil through the pole piece and the core, a permanent magnet device for maintaining the contact-actuating rod in the first position and a spring which preloads the contact-actuating rod, in its second position, towards the first position. An actuator of this kind is known from British patent application GB-A-2,289,374.

There are a number of initial considerations which are important for electromagnetic actuators and deal with the switching safety and the service life of a vacuum switch employed in medium-voltage distribution networks:

1. Switching on is to take place quickly, so that damage caused by the contact surfaces burning in as a consequence of flash-over is limited.
2. Maintaining the switched-on state is to be achieved with a sufficiently high contact pressure, because otherwise excessive contact resistance will lead to dissipation between the contacts, which may cause them to become welded together. This occurs primarily under high short-circuit currents.
3. Opening of the contacts is to take place with a high impulse level, in order to break open any contacts which may have welded together.
4. Opening of the contacts is also to take place at high speed, in order to limit the extent to which the contact surfaces burn in as a result of the arc produced.
5. For the sake of operational reliability of the drive mechanism, it should be sought to keep the number of components as low as possible. The failure of a switch can generally be attributed to a failed drive mechanism.
6. In order to be able to make maximum use of the switching capacity available, it is sometimes desirable to switch off at a specific moment in the current or voltage curve. In a three-phase system, this switching moment may differ for each phase, and the switching pattern may also vary each time depending on the conditions.

In the past, the first five points for consideration have been met by mechanical systems which acted on the basis of energy stored in springs. These systems also allow constant delay times to be achieved. Nevertheless, these drives still fail on occasions.

The abovementioned British patent application relates to a bistable actuator which operates with a set of permanent magnets, a coil and a spring. As soon as a current is fed to the coil, the contact moves into the closed or switched-on state. The field of the coil generated by the current is oriented in the same direction as the magnetic field of the permanent magnet. The total magnetic force brings about easy excitation, only a little current being required in order to move the contacts into the switched-on state. In the switched-on state, the spring is compressed and the actuating rod is held in place by the permanent magnets. The field of the permanent magnets exerts a force on the actuating rod which is greater than the force of the spring and is oppositely directed to the spring force. As soon as the switched-on state of the contacts is reached, the electric current through the coil can be interrupted.

In order to move the contacts into the open or switched-off state, a pulse of electric current is fed to the coil, generating a field which is oppositely directed to that of the permanent magnets. The force on the actuating rod generated by the field of the permanent magnets is thus partially eliminated, so that the actuating rod, on the one hand, is pressed by the energy stored in the spring into the position corresponding to the switched-off state and, on the other hand, is still slowed down to some extent by the residual force generated by the permanent magnets.

Therefore, this known actuator does not fulfil the demands imposed by the inventor that switching off should be quick. This can be attributed to the fact that the magnetic flux, when moving these contacts into the switched-off state, is reduced too slowly in the switched-on state of the contacts.

The switch-on time for an actuator is defined as the time from the start of excitation of the switch-on coil until the point at which the contacts actuated by the actuator come into contact with one another. In the case of actuators for actuating contacts which are suitable for switching high powers, the switch-on time is very great and is not reproducible. Owing to the high self-induction of the switch-on coil of the actuator, the current rises slowly to the maximum achievable level. If, during this build-up of the current, the tensile force of the actuator is sufficiently great to overcome the opposing force occurring in the switched-off state (as a result of, inter alia, friction, switch-off spring, temperature, etc.), the mobile part of the actuator, i.e. the contact-actuating rod, begins to move. The moment at which this happens depends, inter alia, on tolerances in current intensity and friction. The switch-on time, i.e. the time from which the current is switched on until the contacts actually close, is difficult to predict and the switch-on time is therefore variable and not reproducible.

SUMMARY OF THE INVENTION

The object of the invention is to provide an actuator of the type mentioned in the preamble in which the abovementioned problems are avoided and by means of which, inter alia, vacuum switches can be switched on or off at a controlled time, it being possible to switch off the switches very quickly, to switch on switches at a controlled moment and if required to hold the vacuum switches in two stable states.

This object is achieved according to a first aspect of the invention by the fact that a switch-off coil is present, which, for the purpose of moving the contact-actuating rod from the second position to the first position, is excited in order to eliminate the magnetic field of the permanent magnet device at least temporarily, and in that the magnetic flux circuit of the permanent magnet device is separate from that of the switch-on coil.

Owing to the fact that the magnetic circuit of the permanent magnet and that of the switch-on coil are separate, the flux path of the permanent magnets can be shorter, so that smaller magnets will suffice, with the result that the size of the actuator can be smaller. Owing to the fact that the permanent magnets are smaller, their influence lasts for less time when switching off, so that a high switching-off speed is reached. Furthermore, the said separation of flux paths allows the switch-on coil to be utilized optimally. Moreover, in the actuator according to the invention a high holding power is achieved in the switched-on state.

It should be noted that international patent application WO 95/07542 describes a bistable electromagnetic actuator in which a permanent magnet, a movable core and two coils are used. This actuator too has the drawback that the magnetic flux is always closed via the permanent magnet which acts as an air gap for the fields from the coils. As a result, this known actuator is not sufficiently effective.

Further refinements and embodiments of the first aspect of the invention are described in the subclaims.

Furthermore, a second aspect of the invention relates to an electromagnetic actuator for moving a contact into a switched-on or switched-off state, comprising a contact-actuating rod, which is displaceable in the longitudinal direction between a first position, corresponding to the switched-off state, and a second position, corresponding to the switched-on state, a core, which is made of magnetizable material and is attached to the contact-actuating rod, a switch-on coil, which interacts with the core, a pole piece, which is made of magnetizable material and of which that face which is directed towards the core, in the first position of the contact-actuating rod, is arranged at an air-gap distance from that surface of the core which runs perpendicular to the direction of displacement and, in the second position, bears as closely as possible against the said core surface, and a yoke, which is made of magnetizable material, for closing the magnetic flux circuit of the switch-on coil through the pole piece and the core and is characterized by the fact that a locking device is present which acts on the contact-actuating rod, is moved into the locked state when the contact-actuating rod assumes the first position and which is unlocked after a predetermined period after the instant at which a current is supplied to the switch-on coil, which period is greater than the build-up time of the force on the contact-actuating rod which is required to overcome the opposing force occurring in the first position of the contact-actuating rod.

The invention is based on locking the mobile part, in particular the contact-actuating rod, of the actuator in the first position, with the result that a current can build up in the switch-on coil present until the intensity of this current is sufficient for the mobile part to start to move immediately when the locking device is unlocked. The instant at which the movement begins is then determined not by the current intensity in the switch-on coil but rather by the unlocking of the locking device.

Further refinements and embodiments of the invention are described in subclaims.

BRIEF DESCRIPTION OF THE DRAWINGS

The invention will be explained in more detail below with reference to the drawings, in which:

FIG. 9 show graphs of the switch-on current of a known actuator and of an actuator according to the invention as a function of time.

DESCRIPTION OF THE PREFERRED EMBODIMENTS

Figure 2:
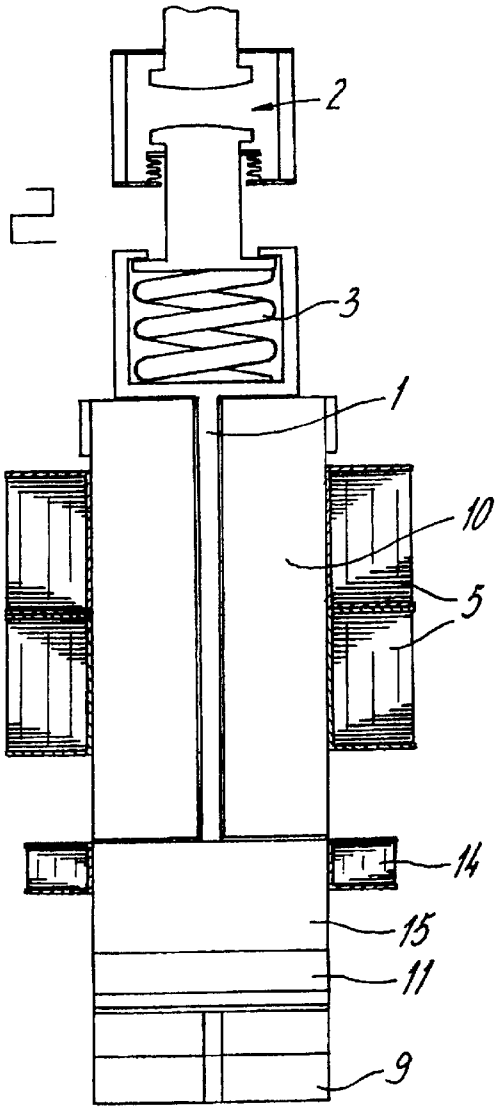
FIG. 2 shows a side view of this actuator in the said state.

The embodiment of the actuator according to the invention which is shown in the figures comprises a contact-actuating rod 1 which is able to move the contact 2 into a closed or switched-on state (cf. FIG. 4) and an open or switched-off state (cf. FIG. 2). For this purpose, the contact-actuating rod is mounted so as to be displaceable in the longitudinal direction and can thus move between a first position, corresponding to the switched-off state of the contact 2, and a second position, corresponding to the switched-on state of the contact 2. In this embodiment, the contact 2 is accommodated in a so-called "vacuum bottle".

Furthermore, a contact compression spring 3 is present in the actuator, which spring, in the switched-on state of the contact 2 (cf. FIG. 4), is compressed, thus pressing the contact pieces of the contact 2 against one another in order to obtain the desired contact pressure. Moreover, this contact compression spring 3, in this switched-on state of the contact 2, preloads the actuating rod 1 in the direction of its first position.

Figure 1:
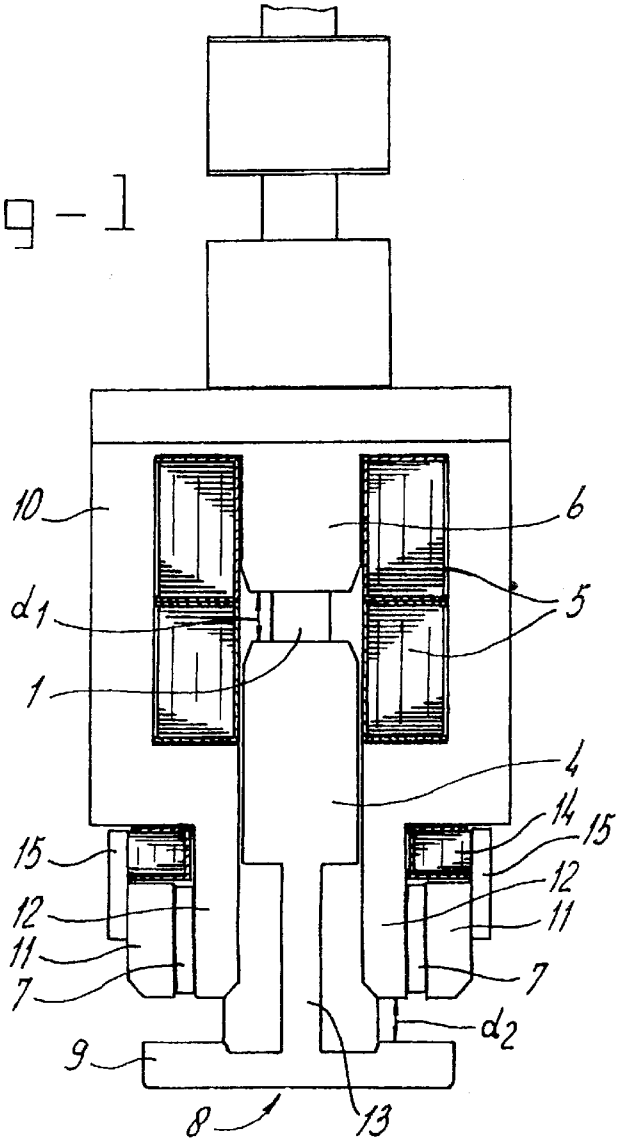
FIG. 1 shows a section along the axis of the actuating rod of the actuator according to the invention in the switched-off state of the associated contact.
Figure 4:
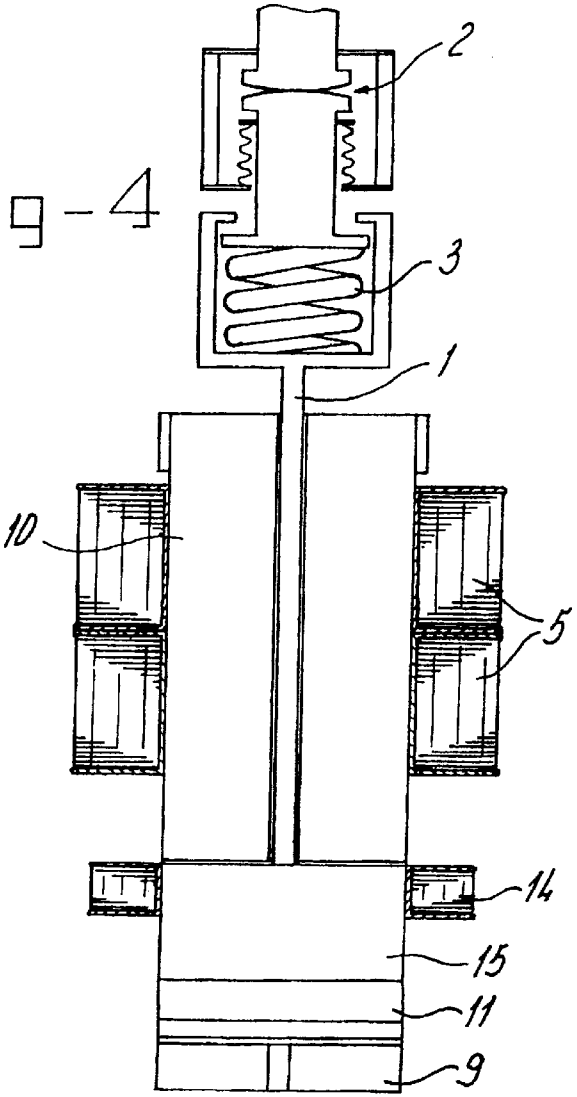
FIG. 4 shows a side view of the actuator shown in FIG. 3.
Figure 3:
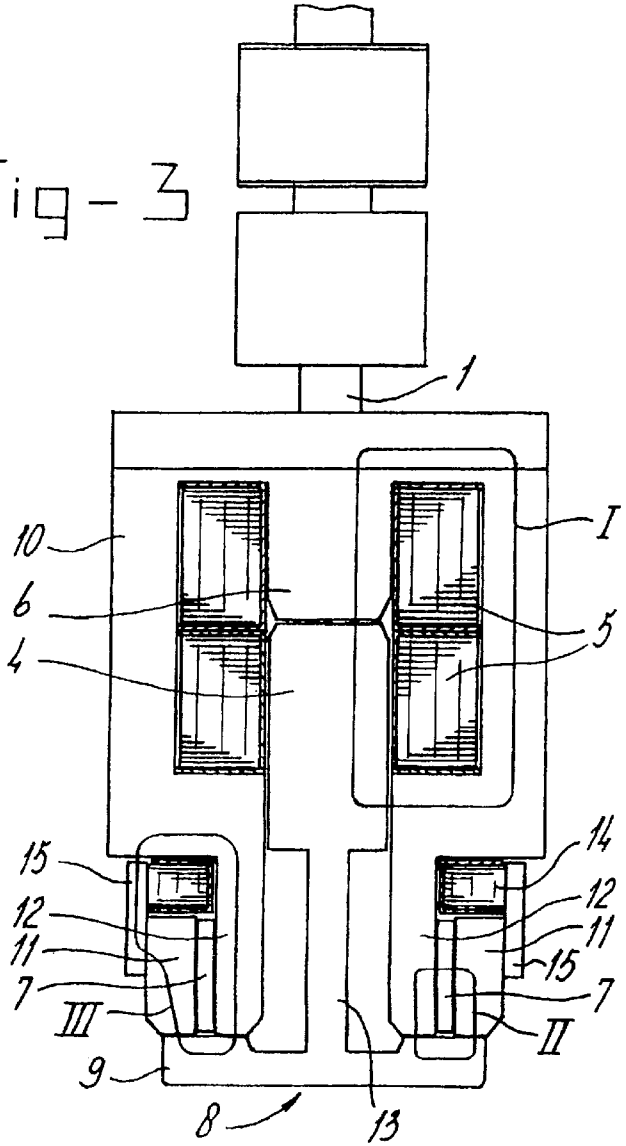
FIG. 3 shows a cross-section through the actuator in the switched-on state.

A core 4, which interacts with a set of switch-on coils 5, is attached to the contact-actuating rod 1. These coils 5 surround the core and a pole piece 6. The core and the pole piece are made from magnetizable material. In the first position, namely the switched-off state of the contact 2, which is shown in FIG. 1, those surfaces of the core 4 and the pole piece 6 which face towards one another have an air-gap distance $d_1$ between them. When the actuator is to be moved from the switched-off state, the first position of the contact-actuating rod 1, which is shown in FIG. 1 into the switched-on state, the second position of the contact-actuating rod 1, which is shown in FIG. 3, the set of coils 5 is excited for a short period, with the result that the core 4 is moved towards the pole piece 6 until the mutually facing surfaces of this core and the pole piece 6 bear as closely as possible against one another. As a result, the preloaded spring 3 is loaded further, as shown in FIG. 4.

Since energy efficiency considerations have led to a short excitation duration being selected, the actuating rod has to be held in the second position counter to the force of the contact compression spring 3. For this purpose, a permanent magnet device is provided, which in the embodiment shown comprises the permanent magnets 7. The North-South direction of these permanent magnets runs in the transverse direction to the axis of the actuating rod 1. These permanent magnets 7 interact with an armature 8 which, in the embodiment shown, comprises two armature elements 9 which run transversely to the axis of the actuating rod and are made from magnetizable material. As shown in FIG. 3, the actuating rod is held in the switched-on state, the second position of the actuating rod 1, which is shown in FIG. 3, by means of the attraction between the magnet 7 and the armature elements 9. In FIG. 3, the associated magnetic flux circuit II is diagrammatically indicated by means of a continuous line and, for the sake of clarity, is only drawn in for the right-hand permanent magnet 7. The magnetic flux circuit of the coils 5 is diagrammatically indicated only on the right-hand side by the line I. The yoke parts, which are to be described below, ensure that the magnetic flux circuits I and II are closed.

It is clear that the magnetic flux circuits I, II of the switch-on coils 5 and the permanent magnet 7, respectively, are completely separate from one another.

The permanent magnets are disposed in such a way that their attraction force is negligible even with an air gap which is smaller than 0.5 mm. As a result, they will not affect the switching-off movement of the actuator.

In contrast to the known actuators, the holding system of the actuator according to the invention which, in the embodiment which is preferably to be used, comprises the permanent magnets 7 and the armature elements 9 is formed in such a way that the flux of the permanent magnets twice crosses an effective air gap (cf. flux circuit II). As a result, a holding power which is twice as high is achieved. When switching off, the holding power per se has an adverse effect on the switching-off movement. However, in this design the double air gap means that the force which the permanent magnets exert on the armature when switching off diminishes very quickly as the air gap becomes larger, so that the adverse effect disappears very rapidly.

The magnetic flux circuit I of the switch-on coils 5 runs through the core 4, the pole piece 6 and the yokes 10.

The permanent magnet device is also provided with flux-guidance elements 11, 12 which guide the magnetic flux towards and through the armature element 9.

Preferably, the yokes 10 and the flux-guidance pieces 11, 12 are produced as a single entity, so that there is no longer any need for adjustments between the air gaps $d_1$ and $d_2$.

Furthermore, the core 4 and the armature elements 9 comprise a single unit that includes a connecting piece 13. This connecting piece 13 preferably has a smaller transverse dimension than the core 4 and the armature elements 9.

The actuator is switched off by the switch-off coil 14, which is disposed in such a way that on excitation the magnetic field which is generated as a result opposes the magnetic field of the permanent magnets. Excitation in pulse form is already sufficient. The switch-off energy is provided by the contact compression spring 3 releasing and, if appropriate, by an additional switch-off spring.

In the embodiment shown, a shunt 15 is provided, by means of which the holding power of the holding system and the sensitivity of the switch-off trip coil 6 can be affected (cf. flux path III). In the embodiment in which the shunt (15) is used, flux path III of the permanent magnet device includes the part (11), the shunt (15), the lower part of the yoke (10) and the part (12). Consequently, flux path III of the permanent magnet (7) will include the portion of the yoke (10) between coils (5) and (14) if the shunt (15) is used. The remaining non-common part: of the magnetic flux circuit of the permanent magnet device is, however, separated from the magnetic flux circuit of the switch-on coil (5). It should also be noted that existing actuators have an excessively slow switching-off action. This is a result of compromises being made between efficient use of the magnetic circuits, air gaps and dispersing flux, as appropriate, the use of permanent magnets and the number of control coils. These drawbacks are remedied here. The advantages of the electromagnetic bistable actuator according to the invention are:

1. High holding power in the switched-on state.
2. High switching-off speed.
3. Optimum utilization of the permanent magnet owing to at least partially separate magnetic circuits and the use of the double air gap for the permanent magnetic circuit.

The second aspect of the invention is explained on the basis of a bistable actuator which is shown in FIGS. 5–8. It should be noted that the invention can be employed in any type of actuator.

Figure 6:
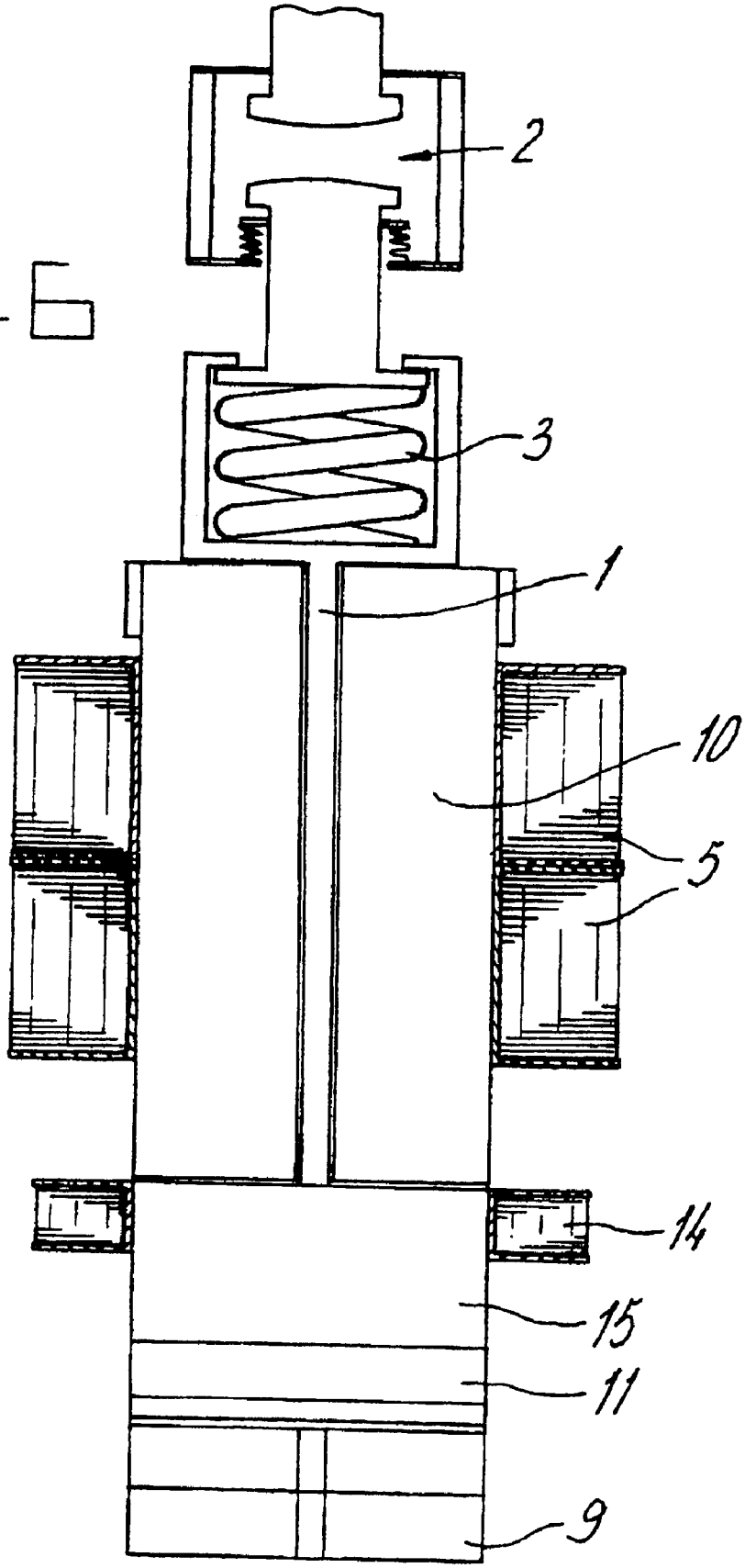
FIG. 6 shows a side view of the actuator shown in FIG. 5, in the said state.

The embodiment of the actuator according to the invention which is shown in the figures comprises a contact-actuating rod 1 which is able to move the contact 2 into a closed or switched-on state (cf. FIG. 8) and an open or switched-off state (cf. FIG. 6). For this purpose, the contact-actuating rod is mounted so as to be displaceable in the longitudinal direction and can thus move between a first position, corresponding to the switched-off state of the contact 2, and a second position, corresponding to the switched-on state of the contact 2. In this embodiment, the contact 2 is accommodated in a so-called "vacuum bottle".

Furthermore, a contact compression spring 3 is present in the actuator, which spring, in the switched-on state of the contact 2 (cf. FIG. 8), is compressed, thus pressing the contact pieces of the contact 2 against one another in order to obtain the desired contact pressure. Moreover, this contact compression spring 3, in this switched-on state of the contact 2, preloads the actuating rod 1 in the direction of its first position.

Figure 5:
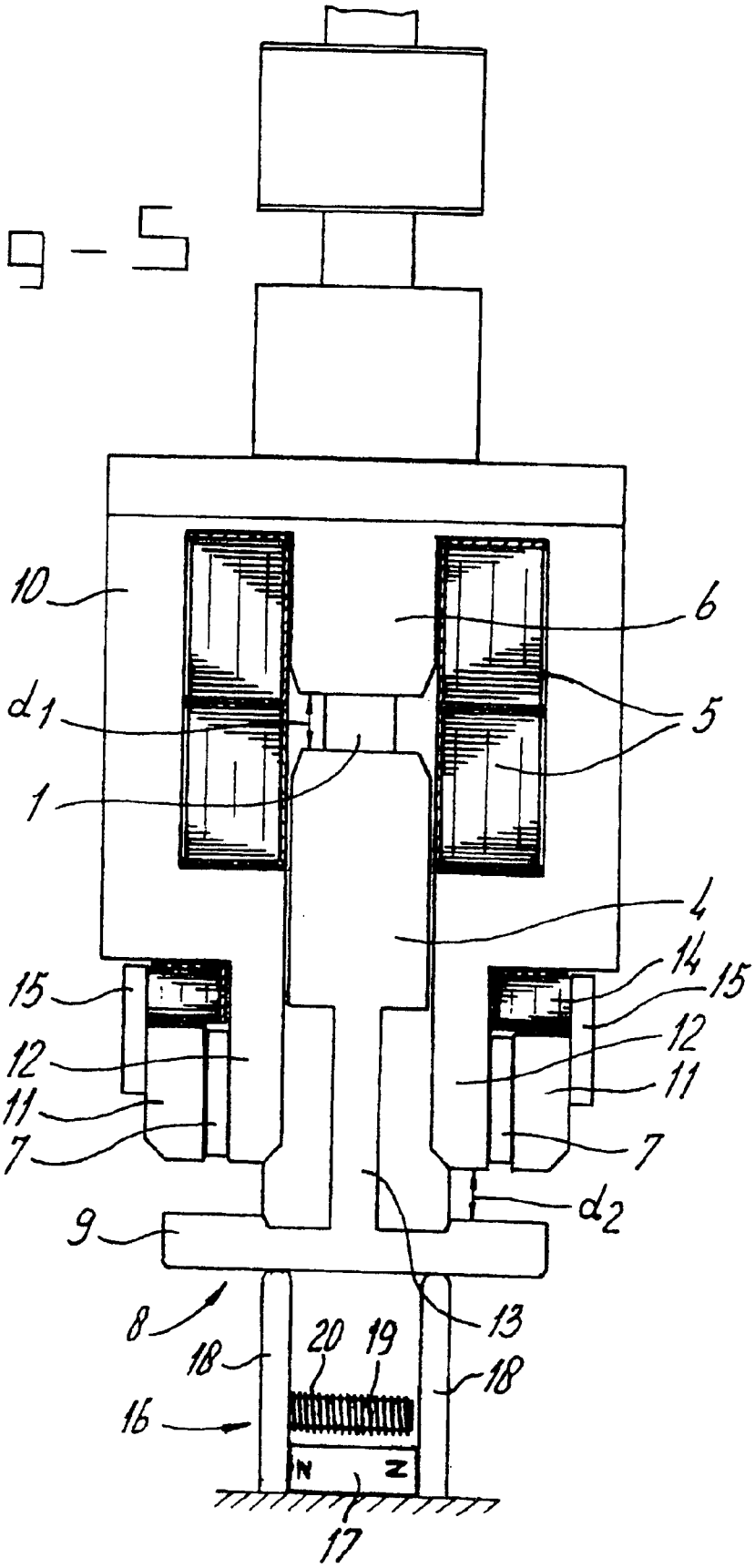
FIG. 5 shows a section along the axis of the actuating rod of an embodiment of the actuator according to the invention in the switched-off state of the associated contact and having an electromagnetic locking device.
Figure 7:
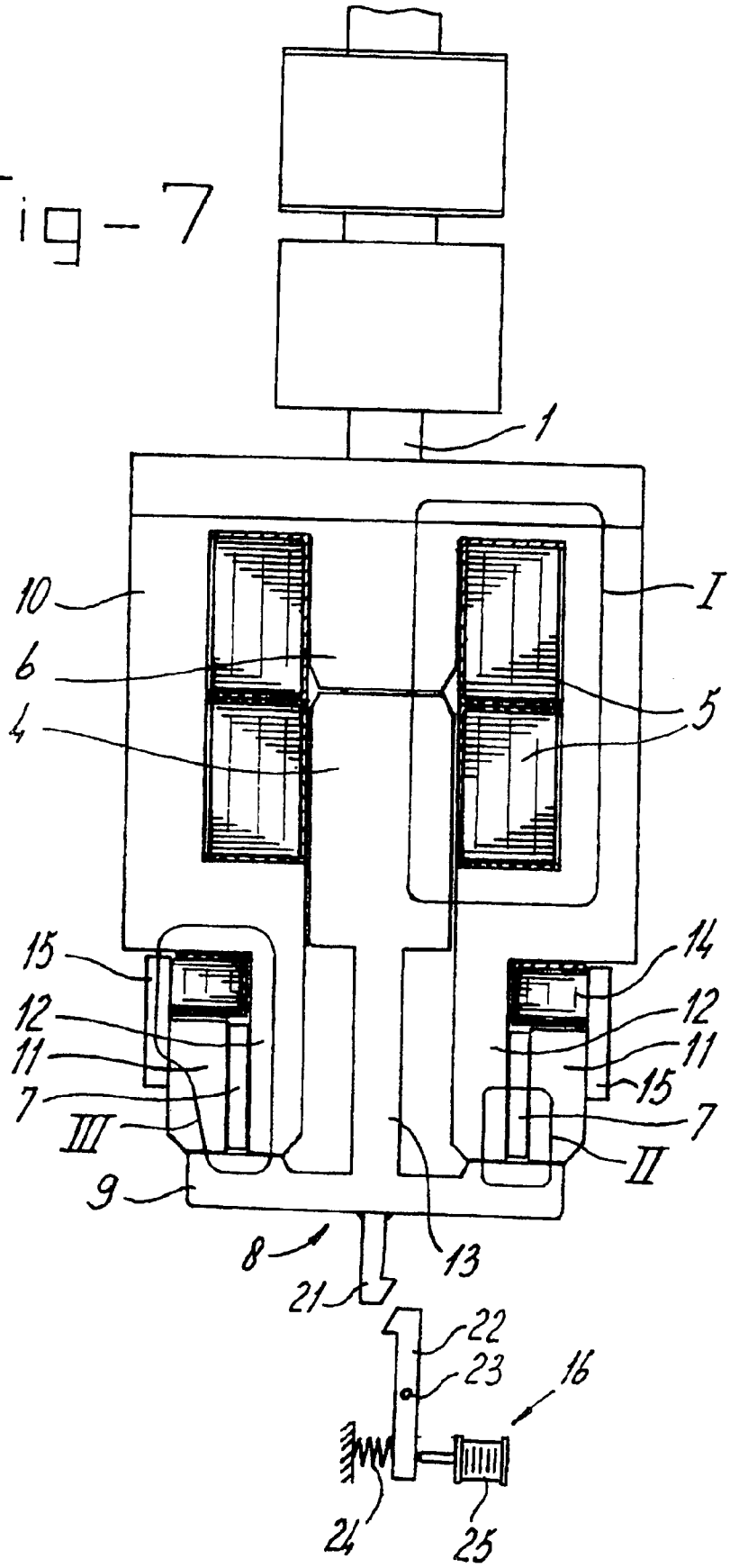
FIG. 7 shows a cross-section through another embodiment of the actuator according to the invention, in the switched-on state and having a mechanical locking device.
Figure 8:
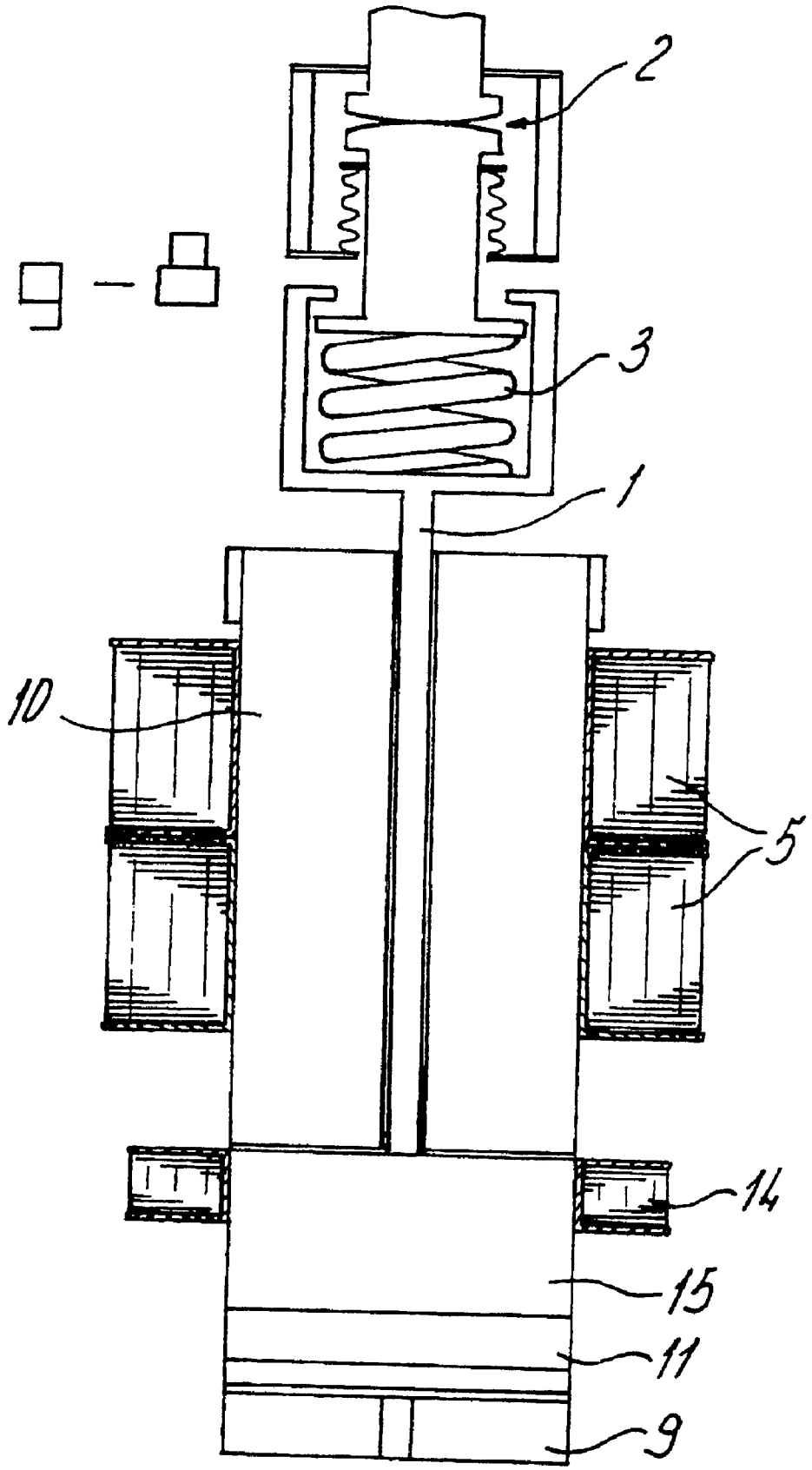
FIG. 8 shows a side view of the actuator shown in FIG. 7.
Figure 5:
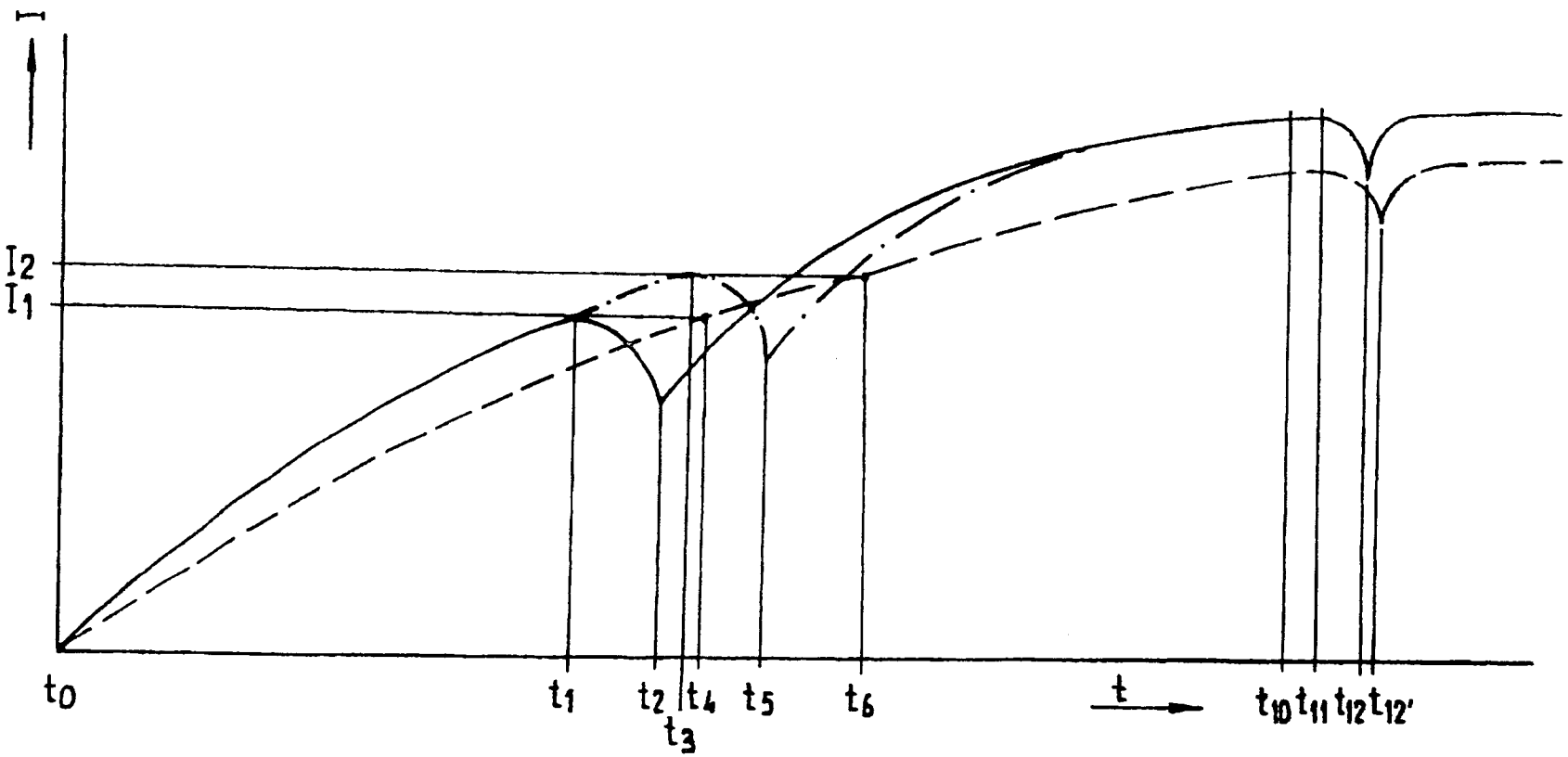

A core 4, which interacts with a set of switch-on coils 5, is attached to the contact-actuating rod 1. These coils 5 surround the core and a pole piece 6. The core and the pole piece are made from magnetizable material. In the first position, namely the switched-off state of the contact 2, which is shown in FIG. 5, those surfaces of the core 4 and the pole piece 6 which face towards one another have an air-gap distance $d_1$ between them. When the actuator is to be moved from the switched-off state, the first position of the contact-actuating rod 1, which is shown in FIG. 5 into the switched-on state, the second position of the contact-actuating rod 1, which is shown in FIG. 7, the set of coils 5 is excited for a short period, with the result that the core 4 is moved towards the pole piece 6 until the mutually facing surfaces of this core and the pole piece 6 bear as closely as possible against one another. As a result, the preloaded spring 3 is loaded further, as shown in FIG. 8.

Since energy efficiency considerations have led to a short excitation duration being selected, the actuating rod has to be held in the second position counter to the force of the contact compression spring 3. For this purpose, a permanent magnet device is provided, which in the embodiment shown comprises the permanent magnets 7. The North-South direction of these permanent magnets runs in the transverse direction to the axis of the actuating rod 1. These permanent magnets 7 interact with an armature 8 which, in the embodiment shown, comprises two armature elements 9 which run transversely to the axis of the actuating rod and are made from magnetizable material. As shown in FIG. 7, the actuating rod is held in the switched-on state, the second position of the actuating rod 1, which is shown in FIG. 7, by means of the attraction between the magnet 7 and the armature elements 9. In FIG. 7, the associated magnetic flux circuit II is diagrammatically indicated by means of a continuous line and, for the sake of clarity, is only drawn in for the right-hand permanent magnet 7. The magnetic flux circuit of the coils 5 is diagrammatically indicated only on the right-hand side by the line I. The yoke parts, which are to be described below, ensure that the magnetic flux circuits I and II are closed.

It is clear that the magnetic flux circuits I, II of the switch-on coils 5 and the permanent magnet 7, respectively, are completely separate from one another.

The permanent magnets are disposed in such a way that their attraction force is negligible even with an air gap which is smaller than 0.5 mm. As a result, they will not affect the switching-off movement of the actuator.

In contrast to the known actuators, the holding system of the actuator according to the invention which, in the embodiment which is preferably to be used, comprises the permanent magnets 7 and the armature elements 9 is formed in such a way that the flux of the permanent magnets twice crosses an effective air gap (cf. flux circuit II). As a result, a holding power which is twice as high is achieved. When switching off, the holding power per se has an adverse effect on the switching-off movement. However, in this design the double air gap means that the force which the permanent magnets exert on the armature when switching off diminishes very quickly as the air gap becomes larger, so that the adverse effect disappears very rapidly.

The magnetic flux circuit I of the switch-on coils 5 runs through the core 4, the pole piece 6 and the yokes 10.

The permanent magnet device is also provided with flux-guidance elements 11, 12 which guide the magnetic flux towards and through the armature element 9.

Preferably, the yokes 10 and the flux-guidance pieces 11, 12 are produced as a single entity, so that there is no longer any need for adjustments between the air gaps $d_1$ and $d_2$.

Furthermore, the core 4 and the armature elements 9 comprise a single unit with connecting piece 13. This connecting piece 13 preferably has a smaller transverse dimension than the core 4 and the armature elements 9.

The actuator is switched off by the switch-off coil 14, which is disposed in such a way that on excitation the magnetic field which is generated as a result opposes the magnetic field of the permanent magnets. Excitation in pulse form is already sufficient. The switch-off energy is provided by the contact compression spring 3 releasing and, if appropriate, by an additional switch-off spring.

In FIG. 9, the switch-on current I of a known actuator is plotted along the ordinate and the time t is plotted along the abscissa.

At the time $t_0$, a voltage is connected to the terminals of the switch-on coil and the switch-on current through the switch-on coil rises slowly as shown by the solid line until the switch-on current I, at time $t_1$, has reached the level $I_1$, which level is associated with the opposing force which has to be overcome, in the switched-off state of the actuator, in order to move this actuator into the switched-on state. At the time $t_1$, the switching-on movement of the contacts actuated by the actuator begins, which contacts only come into contact with one another at time $t_2$. After time $t_2$, the switch-on current I begins to rise again to the maximum level. The opposing force is dependent on factors such as, inter alia, the friction in the actuator, the switch-off spring thereof, which factors are susceptible to variations, in particular under the influence of temperature.

The above influences may give rise to an opposing force which corresponds to the level $I_2$ of the switch-on current. If a voltage is fed to the switch-on coil at time $t_0$, the switching current will again rise as shown by the continuous line and will then rise further as shown by the dot-dashed line. At time $t_3$, the level $I_2$ will be reached, after which the switching-on movement of the actuator begins. At time $t_5$, the contacts which are to be actuated by the actuator come into contact with one another. The switch-on time which is associated with the current $I_1$ is therefore equal to $t_2-t_0$, while in the case of the level $I_2$, the switch-on time is $t_5-t_0$, so that the switch-on time may vary and is not reproducible. Moreover, the voltage associated with the switch-on current may vary, so that at a lower voltage the switch-on current I follows, by way of example, the curve indicated by a dashed line. It can be seen from the graph that at the threshold level $I_1$ the actuator begins its switching-on movement at time $t_4$, while at the threshold level $I_2$ the switching-on movement is started at time $t_6$. It therefore appears that the switch-on time of the actuator is also dependent to a considerable extent on the switch-on voltage.

The relatively high variation in the switch-on time under small variations in threshold level and/or supply voltage for switching on the actuator is reduced according to the invention by the fact that a locking device 16 which acts on the contact-actuating rod 1 is used. This locking device is moved into the locked state when the actuating rod assumes the first position, which corresponds to the switched-off state of the actuator. When the switch-on voltage or current is switched on, the locking device 16 remains in the locked state until a predetermined period has elapsed since the instant at which the switch-on current was switched on. This period is greater than the build-up time of the force on the contact-actuating rod which is required to overcome the opposing force occurring in the first position of the contact-actuating rod 1. In other words, the period is, for example, greater than $t_6-t_0$, which time $t_6$ is the maximum time which can be expected under the cumulative effect of mutually reinforcing influences.

The period can be set as a function of the switch-on current and preferably expires when the current through the switch-on coil has reached a level which is higher than the level which is required to overcome the opposing force occurring in the first position of the contact-actuating rod 1. The start of the switching-on movement is therefore independent of the variable opposing force of the actuator in the switched-off state. In another embodiment, this period has an independent, fixed duration which is greater than $t_6-t_0$. Where t>t6, I is greater, and therefore so is the force. By comparison with the situation without locking, a smaller switch-on coil is sufficient, because the switch-on coil is utilized better.

The switch-on behaviour when unlocked can be seen in the right-hand part of the curve in FIG. 9, the unlocking pulse being emitted at t10, t11–t10 being the response time of the switch-on unlocking.

This response time is much shorter and more reproducible than the response time in the case of an actuator without unlocking. Switching moments t12 and t12', associated with switch-on coil currents which vary as a result of tolerances, lie much closer together than t2 and t5 which illustrate the switching moments without locking.

FIGS. 5 and 6 show an electromagnetic version of the locking device 16, while FIGS. 7 and 8 illustrate a mechanical version of the locking device 16.

The locking device 16 shown in FIGS. 5 and 6 comprises a 15 permanent magnet 17 which is disposed in a fixed position, as indicated by the hatched area. In the switched-off position shown in FIGS. 5 and 6, the armature element 9 bears against the pole plates 18, so that in this switched-off state the magnetic circuit of the permanent magnet is closed across the pole plates 18 and the armature element 9. As a result, the armature element 9 is held in place, as is the associated core 4 and the contact-actuating rod 1. The locking device 16 is furthermore provided with a coil 19 with winding 20, the core of the coil bearing against the pole plates 18.

When a current is supplied to the switch-on coils 5, the actuator is held in the switched-off state shown in FIGS. 5 and 6 and therefore the contact-actuating rod 1 is held in its first position, the contacts 2 actuated by the said rod 1 remaining separate from one another. After the current is switched on, the current in the switch-on coils 5 is built up. The actuator, even if the opposing force were to build up, will remain in the switched-off state until, after a preselected period following the switch-on time of the switch-on current, a current is supplied to the winding 20 of the coil 19, which current has a magnitude and direction which are such that the field of the permanent magnet 17 is eliminated. Then, under the influence of the switch-on current for the switch-on coils 5, the contact-actuating rod 1 can be moved into a switched-on state in which the contact 2 is closed. The switched-on state of the actuator, with closed contact 2, is shown in FIGS. 7 and B. However, these figures show an actuator with a mechanical locking device.

The period of time is selected to be longer than the build-up time of the tensile force of the actuator at which the mobile parts of the actuator begin to move. The length of the period can be derived from the switch-on current or may have a fixed value.

The mechanical locking device 16 which is shown in FIGS. 7 and 8 comprises two lock elements which, in the first position of the contact-actuating rod, engage in one another and hold the contact-actuating rod fixed in this position. One lock element is formed, in the embodiment shown in FIGS. 7 and 8, by the catch 21 which is fixed to the armature element 9. The other lock element in that case is in the form of a grip catch 22 which can pivot about the pin 23. This grip catch 22 is preloaded, in the position shown, by the compression spring 24. The position of the grip catch 22 can be changed by means of a control device which, in this case, is formed by the diagrammatically illustrated auxiliary actuator 25, which may be a conventional low-power electromagnetic actuator.

When the actuator is moved into the switched-off state by supplying a current to the switch-off coil 14, the catch 21 and the grip catch 22 engage in one another, specifically by means of the hook-shaped free ends of the said catches. If a current is then supplied to the switch-on coils 5 in order to switch on the actuator, the engagement between the catches 21 and 22 is retained until a voltage or current is supplied to the auxiliary actuator 25 in order to allow the grip catch 22 to rotate to the right, so that the catch 21 is released from the grip catch 22. This mechanical design of the locking device 16 also maintains the switched-off state of the actuator until a period has elapsed which is greater than the build-up time of the force on the contact-actuating rod 1 which is required to overcome the opposing force occurring in the first position of the contact-actuating rod 1.

Here too, the period of time can be derived from the current supplied to the switch-on coil or may have an independent, fixed value.

The control current for the auxiliary actuator 25 or the winding 20 of the coil 19 could be derived by means of a comparator (not shown), the switch-on current being supplied to one input of the comparator while a reference current is supplied to its other input, which reference current is greater than the level required to overcome the opposing force in the first position of the contact-actuating rod 1. the control current for the auxiliary actuator 25 or the winding 20 of the coil 19, optionally after amplification or processing, can then be supplied to the output of the comparator.

In the embodiment with a fixed period of time, a time switch (not shown) can be used having a fixed, predetermined period of time, the length of which can be selected in accordance with the considerations described above. The time switch is started when the switch-on current for the switch-on coil of the actuator is switched on and the end of the period of time may even lie after the moment at which the switch-on current has reached its maximum level.

What is claimed is:

1. Electromagnetic actuator for moving a contact (2) into a switched-on or switched-off state, comprising a contact-actuating rod (1), which is displaceable in the longitudinal direction between a first position, corresponding to the switched-off state, and a second position, corresponding to the switched-on state, a core (4), which is made of magnetizable material and is attached to the contact-actuating rod (1), a switch-on coil (5), which interacts with the core (4), a pole piece (6), which is made of magnetizable material and of which that face which is directed towards the core (4), in the first position of the contact-actuating rod (1), is arranged at an air-gap distance ($d_1$) from that surface of the core (4) which runs perpendicular to the direction of displacement and, in the second position, bears as closely as possible against the said core surface, a yoke (10), which is made of magnetizable material, for closing the magnetic flux circuit of the switch-on coil through the pole piece (6) and the core (4), a permanent magnet device (8) for maintaining the contact-actuating rod (1) in the second position and a spring (3) which preloads the contact-actuating rod, in its second position, towards the first position, characterized in that a switch-off coil (14) is present, which, for the purpose of moving the contact-actuating rod (1) from the second position to the first position, is excited in order to eliminate the magnetic field of the permanent magnet device at least temporarily, and in that the magnetic flux circuit of the permanent magnet device (8) is at least partially separate from that of the switch-on coil (5) such that the magnetic flux circuit of the permanent magnet device does not extend through an internal space of the switch-on coil.

2. Actuator according to claim 1, characterized in that the spring is at least partially formed by the contact compression spring.

3. Actuator according to claim 1, characterized in that an armature element (9), which runs transversely to the axis of the actuating rod (1) and is made of magnetizable material, is connected to the contact-actuating rod and the permanent magnet device is provided with flux-guidance elements (11, 12) which guide the magnetic flux towards and through the armature element (9).

4. Actuator according to claim 3, characterized in that a magnetic shunt (15) is accommodated in the magnetic flux circuit (II) of the permanent magnet.

5. Actuator according to claim 3, characterized in that the yokes (10) of the switch-on coils and the flux-guidance elements (11, 12) of the permanent magnet device form a single unit.

6. Actuator according to claim 5, characterized in that, in the switched-on state of the contact (2), the air gap ($d_1$) between the core (4) and the pole piece (6) is minimal, but is not zero.

7. Actuator according to claim 3, characterized in that the core (4) and the armature element (9) consist of a single unit that includes a connecting piece (13).

8. Actuator according to claim 7, characterized in that the connecting piece (13) has a smaller transverse dimension than the core (4) and the armature element (9).

9. Electromagnetic actuator for moving a contact (2) into a switched-on or switched-off state, comprising a contact-actuating rod (1), which is displaceable in the longitudinal direction between a first position, corresponding to the switched-off state, and a second position, corresponding to the switched-on state, a core (4), which is made of magnetizable material and is attached to the contact-actuating rod (1), a switch-on coil (5), which interacts with the core (4), a pole piece (6), which is made of magnetizable material and of which that face which is directed towards the core (4), in the first position of the contact-actuating rod (1), is arranged at an air-gap distance ($d_1$) from that surface of the core (4) which runs perpendicular to the direction of displacement and, in the second position, bears as closely as possible against the said core surface, a yoke (10), which is, made of magnetizable material, for closing the magnetic flux circuit of the switch-on coil through the pole piece (6) and the core (4), a permanent magnet device (8) for maintaining the contact-actuating rod (1) in the second position and a spring (3) which preloads the contact-actuating rod, in its second position, towards the first position, characterized in that a switch-off coil (14) is present, which, for the purpose of moving the contact-actuating rod (1) from the second position to the first position, is excited in order to eliminate the magnetic field of the permanent magnet device at least temporarily, and in that the magnetic flux circuit of the permanent magnet device (8) is at least partially separate from that of the switch-on coil (5), and characterized in that the permanent magnet device comprises at least one permanent magnet (7) which is arranged in such a way that the North-South direction thereto is transverse with respect to the axis of the contact-actuating rod (1), in that flux-guidance elements (11,12) are arranged on the North Pole side and on the South Pole side of the magnet (7), which elements have surfaces which run perpendicular to the axis of the contact-actuating rod (1), which, in the first position thereof, lie at an air-gap distance ($d_2$) from the armature element (9) and which, in the second position, bear against the latter, and in that the switch-off coil (14) is positioned in a plane perpendicular to the axis of the contact-actuating rod (1) and on that side of the flux-guidance elements (11, 12) which lies opposite to the armature element (9), the inner surface of the switch-off coil (14) lying in line with that side of the permanent magnet (7) which is directed towards the contact-actuating rod (1).

10. Electromagnetic actuator for moving a contact (2) into a switched-on or switched-off state, comprising a contact-actuating rod (1), which is displaceable in the longitudinal direction between a first position, corresponding to the switched-off state, and a second position, corresponding to the switched-on state, a core (4), which is made of magnetizable material and is attached to the contact-actuating rod (1), a switch-on coil (5), which interacts with the core (4), a pole piece (6), which is made of magnetizable material and of which that face which is directed towards the core (4), in the first position of the contact-actuating rod (1), is arranged at an air-gap distance ($d_1$) from that surface of the core (4) which runs perpendicular to the direction of displacement and, in the second position, bears as closely as possible against the said core surface, and a yoke (10), which is made of magnetizable material, for closing the magnetic flux circuit of the switch-on coil through the pole piece (6) and the core (4), characterized in that a switch-off coil (14) is present, which moves the contact-actuating rod (1) from the second position to the first position and eliminates the magnetic field of a permanent magnet device (8) at least temporarily, and a locking device (16) is present which acts on the contact-actuating rod (1), is moved into the locked state when the contact-actuating rod (1) assumes the first position and which is unlocked after a predetermined period after the instant at which a current is supplied to the switch-on coil (5), which period is greater than the build-up time of the force on the contact-actuating rod (1) which is required to overcome the opposing force occurring in the first position of the contact-actuating rod.

11. Actuator according to claim 10, characterized in that the period expires when the current through the switch-on coil (5) has reached a level which is higher than the level which is required to overcome the opposing force occurring in the first position of the contact-actuating rod (1).

12. Actuator according to claim 10, characterized in that the period of time has an independent, fixed duration.

13. Actuator according to claim 10, characterized in that the locking device (16) comprises a permanent magnet (17), which holds the contact-actuating rod (1) in its first position, and a coil (19) for eliminating the field of the permanent magnet (17).

14. Actuator according to claim 13, characterized in that a comparator is present, the switch-on current of the switch-on coil (5) being supplied to one input thereof and a reference signal being supplied to the other input, and the output thereof being coupled to the coil (19).

15. Actuator according to claim 13, characterized in that the coil (19) is controlled by a time switch having a fixed, predetermined duration.

16. Actuator according to claim 10, characterized in that the locking device (16) comprises two lock elements which, in the first position of the contact-actuating rod (1), engage in one another and hold the contact-actuating rod fixed in this position, and in that a control device is present which, after the period of time, disengages the lock elements.

17. Actuator according to claim 13, characterized in that the control device is an electromagnetic auxiliary actuator.

18. Actuator according to claim 16, characterized in that a comparator is present, current of the switch-on coil (5) being supplied to one input thereof and a reference signal being supplied to the other input, and the output thereof being coupled to the control device.

19. Actuator according to claim 16, characterized in that the control device is controlled by a time switch having a fixed, predetermined duration.

* * * * *